US007077622B2

(12) United States Patent
Ehrhard et al.

(10) Patent No.: US 7,077,622 B2
(45) Date of Patent: Jul. 18, 2006

(54) EMERGENCY COOLING SYSTEM FOR A THERMALLY LOADED COMPONENT

(75) Inventors: Jan Ehrhard, Baden (CH); Maxim Konter, Klingnau (CH); Shailendra Naik, Gebenstorf (CH); Ulrich Rathmann, Baden (CH)

(73) Assignee: ALSTOM Technology Ltd., Baden (CH)

( * ) Notice: Subject to any disclaimer, the term of this patent is extended or adjusted under 35 U.S.C. 154(b) by 314 days.

(21) Appl. No.: 10/694,738

(22) Filed: Oct. 29, 2003

(65) Prior Publication Data

US 2004/0226682 A1 Nov. 18, 2004

(30) Foreign Application Priority Data

Oct. 30, 2002 (DE) ..... 102 50 779

(51) Int. Cl.
*F01D 21/12* (2006.01)

(52) U.S. Cl. ..... 415/9; 415/47; 416/2; 416/39

(58) Field of Classification Search ..... 415/9, 415/115, 47; 416/39, 2, 96 R, 96 A, 97 R, 416/224

See application file for complete search history.

(56) References Cited

U.S. PATENT DOCUMENTS 2,977,090 A * 3/1961 McCarty et al. ..... 416/96 R
3,377,957 A * 4/1968 Bilton ..... 415/9
3,626,568 A * 12/1971 Silverstein et al. ..... 29/889.72
4,136,516 A * 1/1979 Corsmeier ..... 60/39.091
6,276,597 B1 * 8/2001 Budinger et al. ..... 228/225
6,454,156 B1 * 9/2002 Taras et al. ..... 228/165
6,883,700 B1 * 4/2005 Kottilingam et al. ..... 228/119

FOREIGN PATENT DOCUMENTS

DE 25 54 523 A1 6/1976
DE 28 23 496 A1 12/1978
DE 38 21 005 C2 1/1992
DE 102 25 264 A1 4/2003

OTHER PUBLICATIONS

Search Report in EP 03103975.3 (Nov. 26, 2003).
Search Report in DE 102 50 779.1 (Apr. 24, 2003).

* cited by examiner

*Primary Examiner*—Edward K. Look
*Assistant Examiner*—Nathan Wiehe
(74) *Attorney, Agent, or Firm*—Cermak & Kenealy, LLP; Adam J. Cermak

(57) ABSTRACT

In an emergency cooling system (17) for a component (1) which is subject to thermal load in operation, in, e.g., a turbine, the component (1) has a wall (3) which, in operation, is acted on by heat on a first wall side (14) and is acted on by a flow of cooling fluid (11) on a second wall side (15). The wall (3) has at least one emergency cooling opening (12) which is closed off by a plug (16) and through which cooling fluid flows from the second wall side (15) to the first wall side (14) when the plug (16) is absent. The plug (16) is designed so as to melt at a predetermined temperature. The plug (16) is a body which is produced separately from the component (1), the plug (16) being inserted into the emergency cooling opening (12), in which it is connected to the component (1).

32 Claims, 2 Drawing Sheets

EMERGENCY COOLING SYSTEM FOR A THERMALLY LOADED COMPONENT

BACKGROUND OF THE INVENTION

1. Field of the Invention

The present invention relates to an emergency cooling system for a component which is subject to thermal load in operation, in particular a component of a turbine. The invention also relates to a plug and to a component which are suitable for use in an emergency cooling system of this type.

2. Discussion of Background

Thermally loaded components are to be found, for example, in gas turbines. In particular, in gas turbines guide vanes, rotor blades and heat shields are exposed to flows of hot gases. On account of the temperatures of the hot gases which surround them, these components have to be cooled. One particular difficulty is that of reliably cooling certain regions of the components in question which have been particularly exposed to the thermal loading. One of these certain regions is, for example, a shroud or shroud element of the blade or vane and a cavity which is formed between fins of the shroud element. Intensive cooling is required here to reliably prevent overheating. Overheating at this location leads to oxidation and to deformation of the shroud element and therefore to a larger gap being formed between the thermally protective shield located opposite the turbine blade or vane and the turbine blade or vane itself. An enlarged gap leads to a greater quantity of hot gas flowing into the cavity and therefore to further overheating, with terminal consequences for the gas turbine. Cooling of the corresponding thermally loaded components, for example of a turbine component, is designed for a nominal operating point of the appliance fitted with this component, for example of a gas turbine, in order in this way to ensure the required cooling within this nominal operating point. Nevertheless, operating situations may arise in which the thermal load on the component in question exceeds the thermal load provided for the nominal operating state. However, for efficiency reasons, cooling is restricted to the extent required for the design point, in order to avoid energy-consuming, unnecessary cooling at the design point.

An air-cooled turbine blade or vane, which at its tip has a shroud element extending perpendicular to its longitudinal axis, is known from German patent application DE 102 25 264.5 on Jun. 7, 2002, which had not yet been published on the application date of the present patent application. This shroud element has at least one cooling-air hole passing all the way through it for cooling purposes, and on the inlet side this hole is in communication with at least one cooling-air passage which runs through the turbine blade or vane, while on the outlet side it opens out into the outer space which surrounds the turbine blade or vane. Inside the cooling-air hole there is a valve which opens as a function of the temperature of the outer space which surrounds it. This valve may be formed, inter alia, by a plug which consists of a material which melts as soon as a certain temperature is reached. The result of this is that during normal operation of the turbine blade or vane, the plug keeps the cooling-air hole closed and only opens it up when the tip of the turbine blade or vane threatens to overheat, i.e. in situations in which there is an extraordinarily high thermal load. In this way, it is possible to prevent the turbine blade or vane from overheating. This design therefore provides an emergency cooling system which, in the event of the thermal load on the component exceeding a predetermined limit, opens up an emergency cooling opening as a result of the plug melting, so that the cooling air can then pass through this opening into the overheated outer space. This results firstly in a drop in the mixing temperature in the vicinity of the component which is to be cooled, so that the thermal load on'this component is reduced, and secondly the cooling air blown out leads to an increase in pressure in the area surrounding the component which is to be cooled, with the result that the mass flow of hot gas acting on the component is reduced, which likewise lowers the thermal load on the component.

The abovementioned DE 102 25 264.5 does not describe how the plug can be introduced into the cooling-air hole. By way of example, it would be conceivable for the plug to be cast into the cooling-air hole while the turbine blade or vane in question is being produced. However, this procedure may make the subsequent replacement of a plug, which has melted out in the event of an emergency, a relatively complex operation.

SUMMARY OF THE INVENTION

Accordingly, one object of the present invention is to resolve the problem for an emergency cooling system of the type described in the introduction by providing an improved embodiment which in particular allows simplified maintenance.

The present invention is based on the general idea of designing the component and the associated plug(s) as separate bodies so that the plug forms an insert element which can be inserted into the emergency cooling opening provided for this purpose in the component and can be connected to the component in this emergency cooling opening. By this procedure, it is fundamentally possible to configure the plug in such a way that—given suitable accessibility to the component—it can be introduced into the associated emergency cooling opening even with the component in question in its installed state and can then be sufficiently securely connected to the component. It will be clear that the initial equipping of the component with the plug may expediently take place before the component is installed. At any rate, the proposed design simplifies the introduction of the plug into the associated emergency cooling opening when the component has already been mounted, in particular when the emergency cooling opening or openings in question is/are to be closed up again by a suitable plug as part of maintenance work after the emergency cooling system has previously been activated.

Depending on the alloy used for the plug, it may in principle be possible for the plug to be sufficiently securely connected to the component by the plug being soldered or welded into the associated emergency cooling opening.

However, it is preferable to use an embodiment in which the plug is connected to the component in a positively locking manner in the associated emergency cooling opening. This means that the plug and the emergency cooling opening are matched to one another, by suitable shaping, in such a way that the plug can only escape from the emergency cooling opening in the event of an emergency, when its shape changes.

According to an advantageous refinement, the plug may have a first positive locking contour, while the emergency cooling opening has a second positive locking contour, which is of complementary design to the first positive locking contour, the two positive locking contours then being designed or matched to one another in such a way that the plug can be inserted into the emergency cooling opening on the first wall side, which is acted on by heat during operation, of the component. This procedure facilitates introduction of the plug into the associated emergency cooling opening when the component has already been installed, for example when the plug is to be replaced after the emergency cooling system has been activated. By way of example, the positive locking contours may form a threaded closure or a bayonet catch.

According to a particularly advantageous embodiment, the plug may have a plug body, the material of which has a predetermined melting point at which the emergency cooling system is to be activated, this plug body, on its outer side, having a protective layer which is designed such that it serves as a diffusion barrier between the material of the plug body and the material of a wall which includes the emergency cooling opening and/or that it protects the plug body, in particular on the first wall side and/or on the second wall side, from oxidation and/or corrosion and/or erosion. In particular if the component is part of a turbine, long-term application of a very high temperature to the component may cause elements of the plug alloy to diffuse into the material of the component and/or vice versa. This may alter the melting point of the plug, so that the plug opens up the emergency cooling opening either too early or too late. A protective layer designed as a diffusion barrier prevents or impedes diffusion of this nature. Furthermore, in particular turbine components may be exposed to high levels of oxidation, corrosion and/or erosion. Depending on the particular alloy used for the plug body, the material of the plug body which is optimized toward a predetermined melting point may be unable to withstand these attacks, especially at the high temperatures prevailing, for long, so that these phenomena too may endanger the operational reliability of the emergency cooling system. By providing a suitably configured protective layer, it is possible to protect the sensitive material of the plug body from oxidation, erosion and/or corrosion to a sufficient degree.

Further important features and advantages of the present invention will emerge from the drawings and from the associated description of the figures on the basis of the drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
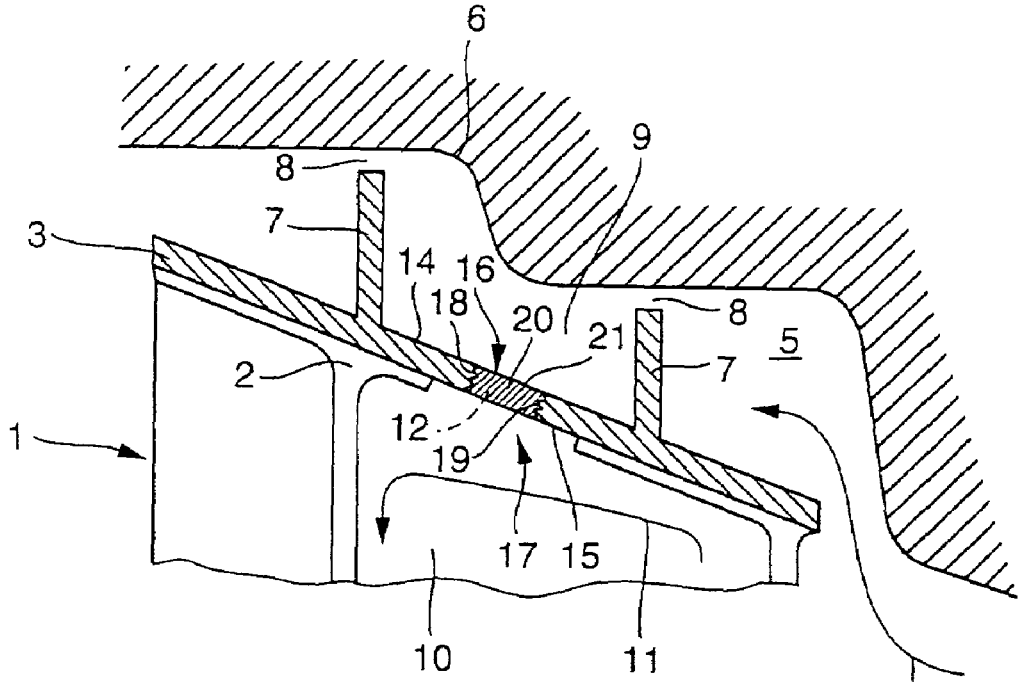
FIG. 1 diagrammatically depicts a sectional view through a component which is equipped with an emergency cooling system according to the invention, with the emergency cooling opening closed, FIG. 2 diagrammatically depicts a similar view to that shown in FIG. 1, but with the emergency cooling opening open.
Figure 2:
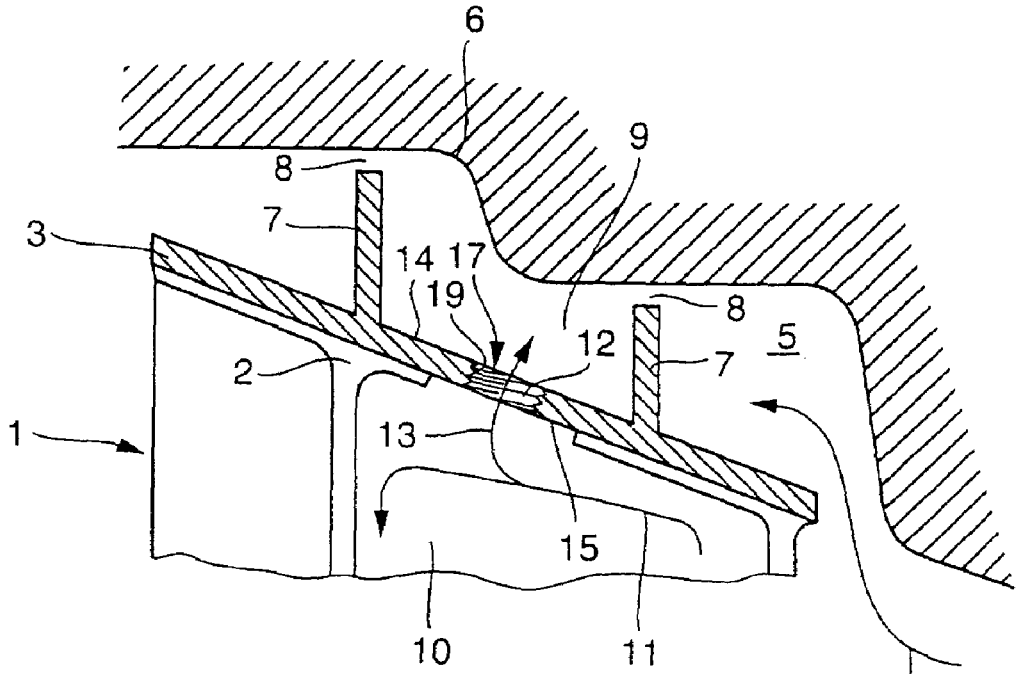

Referring now to the drawings, wherein like reference numerals designate identical or corresponding parts throughout the several views, FIGS. 1 and 2 illustrate a component 1 which is subject to thermal load in operation, the component 1 being formed, in the embodiments selected, by way of example, by a rotor blade of a turbine. In principle, the component 1 may also be any other desired component, in particular a component of a turbine, such as for example a guide vane or a heat shield, which is exposed to thermal load in operation or in the particular application. In the text which follows, therefore, the invention is explained by way of example with reference to the turbine blade 1, without restricting its general applicability.

The turbine blade 1 is equipped at its tip 2 with a shroud element 3 which extends transversely with respect to the blade tip 2, in the peripheral direction. The shroud element 3 in this case forms a wall of the component 1, which is also referred to below by the reference numeral 3. In operation, hot gas 4 flows onto the turbine blade 1 and in doing so also flows into an annular space 5 which is formed radially between the shroud element 3 and a housing 6 of a gas turbine, which is not otherwise illustrated, which the turbine blade 1 is arranged opposite.

Together with other turbine blades 1, which adjoin it in the peripheral direction and are not shown here, the shroud element 3 forms a continuous, mechanically stabilized shroud. On its top side, facing away from the turbine blade 1, the shroud element 3 has two sealing fins 7 which run in parallel in the direction of movement of the blade tip 2 and, together with the opposite housing wall 6 of the gas turbine, form a cavity 9 which is connected to the environment through gap 8.

The interior of the turbine blade 1 is partially hollow and has one or more cooling passages 10 passing through it, these passages carrying a cooling fluid, in particular cooling air 11, from a blade root (not shown in FIGS. 1 and 2) to the blade tip 2.

The component 1, i.e. in this case the turbine blade 1, has at least one emergency cooling opening 12, which is formed in the wall 3, i.e. in this case in the shroud element 3, between the sealing fins 7. In FIG. 2, the emergency cooling opening 12 has been opened up, with the result that a partial stream 13 of the cooling fluid can enter the cavity 9 from the cooling passage 10 through the emergency cooling opening 12.

At least in the region of the emergency cooling opening 12, the component 1 has a first wall side 14 which is exposed to the cavity 9 and is therefore acted on by heat when the gas turbine is operating, and a second wall side 15, which is exposed to the cooling passage 10 and is therefore acted on by the flow of cooling fluid 11 when the gas turbine is operating. When the emergency cooling opening 12 has been opened up, therefore, cooling fluid 13 flows from the second wall side 15 to the first wall side 14.

In a starting state as shown in FIG. 1, the emergency cooling opening 12 is closed up by a plug 16. This plug 16 is designed so as to melt at a predetermined temperature and thereby open up the emergency cooling opening 12. The emergency cooling opening 12, together with the meltable plug 16, therefore forms an emergency cooling system 17 for the component 1.

When the gas turbine is operating normally, the emergency cooling opening 12 is tightly closed by the plug 16, so that no cooling air 11 flows from the cooling passage 10 into the cavity 9 and therefore this region is not separately cooled. The internal cooling through the cooling passage 10 is designed for this normal operating state of the gas turbine, so that there is no expectation of the turbine blade 1 overheating. However, if the gas turbine is operated at above the nominal operating point, an increased thermal load is applied to the turbine blade 1. As soon as a predetermined temperature is reached, the emergency cooling system 17 is activated by the plug 16 melting so that the emergency cooling opening 12 is opened up, as shown in FIG. 2. The melting point of the plug 16 is in this case selected such that the plug 16 melts when there is a risk of the turbine blade 1 or the shroud element 3 overheating.

The cooling air 13 which is blown out when the emergency cooling opening 12 is opened leads to an increase in the pressure in the cavity 9 and therefore contributes to a reduced mass flow of hot gas 4 penetrating into the cavity 9. At the same time, this also reduces the mixing temperature in this region, with the result that overall the thermal load on the shroud element 3 on the top side facing the housing 6, i.e. on the first wall side 14 of the component 1, is reduced.

According to the invention, the plug 16 forms a body which is produced separately from the component 1, i.e. separately from the turbine blade 1 or separately from the shroud element 3. The plug 16 therefore forms an insert part which can be inserted into the emergency cooling opening 12 and, in the inserted state, is fixedly connected to the component 1. This makes it possible in particular, during maintenance with the component 1 in its installed position, to insert the plug 16 securely into the emergency cooling opening 12 in order to close off the latter after the emergency cooling system 17 has been activated.

In this case, it is in principle possible for the plug 16 to be soldered or welded into the emergency cooling opening 12 in order to fixedly connect the plug 16 to the component 1.

In the embodiment shown here, however, the plug 16 is connected to the component 1 in the emergency cooling opening 12 by means of a positive lock. A positive lock of this type can in principle be produced by suitable pairing of complementary positive locking contours 18, 19, in which case a first positive locking contour 18 is formed on the plug 16, while a complementary second positive locking contour 19 is formed in the emergency cooling opening 12 on the component 1. With suitably prepared elements (component 1 and plug 16), it is particularly easy to realize a positively locking connection and to carry out such a connection in particular as part of routine maintenance. This considerably reduces the outlay involved compared to a welded or soldered joint. Nevertheless, it may be expedient to provide a soldered or welded joint in addition to the positively locking connection 18, 19, for example for safety reasons.

An embodiment in which the two positive locking contours 18; 19 are matched to one another in such a way that the plug 16 can be inserted into the emergency cooling opening 12 from the first wall side 14 is particularly expedient. This embodiment takes into account the fact that the first wall side 14 of the component 1, at least in the installed state, generally offers better access than the second wall side 15, which correspondingly facilitates assembly.

In the preferred embodiment shown here, the two interacting positive locking contours 18, 19 form a threaded closure, meaning that the first positive locking contour 18 is formed by an external screw thread formed on the plug 16 and also referred to below by reference numeral 18. Correspondingly, the second positive locking contour 19 is then formed by an internal screw thread, which is designed to be complementary with respect to the external screw thread 18 and is introduced into the emergency cooling opening 12 on the component 1, i.e. in this case on the shroud element 3, and is also referred to below by the reference numeral 19. This design makes it particularly easy to screw the plug 16 into the associated emergency cooling opening 12. It will be clear that this threaded closure 18, 19 is designed in such a way that the plug 16 is seated sufficiently securely in the emergency cooling opening 12, such that the plug 16, when the component 1 is operating, cannot automatically become unscrewed.

Figure 3:
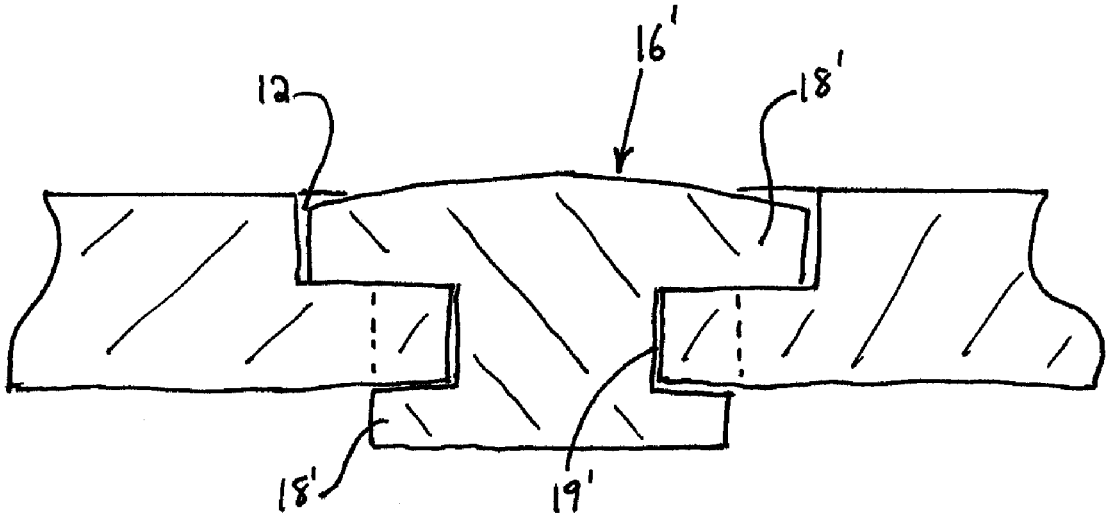
FIG. 3 diagrammatically depicts an enlarged view similar to that illustrated in FIG. 1, according to another exemplary embodiment of the present invention.

In another embodiment, illustrated in FIG. 3, positive locking contours 18', 19' may form a bayonet catch, in which case a plug 16' has first bayonet catch elements, for example laterally projecting pins 18', while the emergency cooling opening 12 has corresponding, complementary second bayonet catch elements, for example suitable pin receptacles 19', so that the plug 16' can be anchored in the emergency cooling opening 12.

Since operating states with an increased thermal load do not necessarily occur for unacceptably long periods of time in gas turbines, but rather may also occur for only short times which are still within the load limits of the component 1 or of the shroud section 3, the plug 16 is expediently configured in such a way that it melts at least when it has been subject to the predetermined temperature for a predetermined period of time. The result of this embodiment is that the plug 16 is able to withstand excessive temperatures for a short time and only melts after these excessive thermal loads have obtained for a prolonged period of time, so that the emergency cooling opening 12 is then opened up. The result of this design is that the emergency cooling opening 12 is only opened up when there is an increased probability of thermal overloading of the component 1 in question.

By selecting a suitable material for the plug 16, it is possible to deliberately select its melting point in such a way that on the one hand it is greater than a maximum temperature which is permissible at the particular critical location in normal operation of the component 1 and on the other hand is lower than the melting point of the component 1 in this critical region. This targeted setting of the melting point of the plug 16 prevents the emergency cooling opening 12 from being opened up prematurely and may, for example, increase its efficiency when used in a gas turbine.

To enable additional cooling of the critical region of the component 1 equipped with the emergency cooling opening 12 to be activated sufficiently quickly by the emergency cooling system 17, the plug 16 is expediently configured, or selected in terms of its alloy, in such a way that it melts relatively quickly when its melting point is reached. In this configuration, the plug 16 opens up the emergency cooling opening 12 for activation of the emergency cooling system 17 correspondingly quickly when the predetermined critical thermal load is reached.

It is preferable for the plug 16 to have a plug body 20 which is surrounded by a protective layer 21. The solid plug body 20, in terms of its alloy, is matched to the predetermined melting point. By contrast, the protective layer 21 is selected in such a way that at normal operating temperatures it protects the plug body 20 from oxidation, corrosion and erosion, for example on the first wall side 14 and in particular also on the second wall side 15. Furthermore, the protective layer 21 is expediently also designed as a diffusion barrier, in order to prevent diffusion of alloying constituents from the plug body 20 into the component 1 and/or vice versa between the material of the plug body 20 and the material of the component 1.

An Ni-based alloy which, in addition to Ni, also contains at least one of the following alloying constituents: Hf, Si, Zr, Cr, Al, Ti, Ta, Nb, B, Co, is expediently used to produce the plug body 20. To provide the plug 16 or the plug body 20 with a predetermined melting point Tm, the Ni alloy can be defined on the basis of the following equation:

$$Tm=(1460-9.5\times Hf-30\times Si-170\times Zr-2.75\times Cr-9.4\times Al-10.6\times Ti-10.8\times Nb-B+1\times Co)^\circ\ C.$$

In this equation, the individual alloying constituents selected for the Ni alloy are in each case used in their percentages by weight. The percentage by weight is also referred to below by % by weight. Example: the Ni alloy selected consists of 70% by weight of Ni and 30% by weight of Hf. For the plug 16 or the plug body 20, this gives the melting point Tm as follows:

$$Tm=(1460-9.5\times30)^\circ\ C.=1175^\circ\ C.$$

This means that the Ni—Hf alloy containing 30% by weight of Hf has a melting point of approximately 1175° C.

Therefore, with the aid of the above equation, it is particularly easy to determine the effect of a variation in the percentages by weight of the individual alloying constituents on the melting point Tm which can be achieved.

The following Ni alloys are particularly suitable for production of the plug 16 or the plug body 20:

A Ni—Hf alloy containing from 25 to 30% by weight of Hf, remainder Ni.

A Ni—Si alloy containing from 7 to 12% by weight of Si, remainder Ni.

An Ni—Hf—Si alloy containing from 20 to 30% by weight of Hf, from 5 to 12% by weight of Si, remainder Ni.

An Ni—Hf—Si—Cr—Al alloy containing from 10 to 30% by weight of Hf, from 5 to 12% by weight of Si, from 5 to 30% by weight of Cr, from 2 to 5% by weight of Al, remainder Ni.

An Ni—Hf—Cr—Al—Si—Co—Ti—Ta—Nb—Zr alloy containing from 5 to 20% by weight of Hf, from 5 to 30% by weight of Cr, from 2 to 5% by weight of Al, from 4 to 12% by weight of Si, from 0 to 25% by weight of Co, from 0 to 5% by weight of Ti, from 0 to 5% by weight of Ta, from 0 to 5% by weight of Nb, from 0.3 to 3% by weight of Zr, remainder Ni.

An Ni—Hf—Cr—Al—Si—Co—Ti—Ta—Nb—Zr—B alloy containing from 5 to 20% by weight of Hf, from 5 to 30% by weight of Cr, from 2 to 5% by weight of Al, from 4 to 12% by weight of Si, from 0 to 25% by weight of Co, from 0 to 5% by weight of Ti, from 0 to 5% by weight of Ta, from 0 to 5% by weight of Nb, from 0.3 to 3% by weight of Zr, from 0 to 2.5% by weight of B, remainder Ni.

Since B has a relatively high capacity for diffusion, a Ni alloy containing B as an alloying constituent results in a reduced stability with regard to the melting point which is set under long-term loads at high temperatures. Accordingly, a Ni alloy containing B as an alloying constituent is expediently only used if the plug 16 or the plug body 20 is to have a relatively low melting point.

The addition of Ta has no significant influence on the melting point Tm but may be advantageous for the Ni alloy with regard to its resistance to oxidation and its reduced tendency toward diffusion.

The protective layer 21 with which the plug body 20 is covered on its outer side may, for example, consist of a thin Pt layer which is applied, for example, by electroplating and, by way of example, may be 15 to 80 microns thick. It is also possible for the protective layer 21 to be formed from a combination of a Pt layer and a Al layer, in which, by way of example, Pt is applied to the plug body 20 by electroplating, whereas Al is then applied to the Pt layer by means of a chemical vapor deposition (CVD) technique. Furthermore, it is possible for the protective layer to be produced only from an Al layer or from an Al alloy layer. This coating too is relatively thin, with a thickness of, for example, 15 to 120 microns.

Obviously, numerous modifications and variations of the present invention are possible in light of the above teachings. It is therefore to be understood that within the scope of the appended claims, the invention may be practiced otherwise than as specifically described herein.

LIST OF DESIGNATIONS

1 Component/turbine blade
2 Blade tip
3 Wall/shroud elements
4 Hot gas flow
5 Annular space
6 Housing
7 Sealing fin
8 Gap
9 Cavity
10 Cooling passage
11 Cooling fluid flow
12 Emergency cooling opening
13 Cooling fluid partial flow
14 First wall side
15 Second wall side
16, 16' Plug
17 Emergency cooling system
18 First positive locking contour/external screw thread of 16
18'First positive locking contour/internal screw thread of 16'
19 Second positive locking contour/internal screw thread of 12
19'second positive locking contour/pin receptacles of 12

The invention claimed is:

1. An emergency cooling system for a component which is subject to thermal load in operation, comprising:

a component having a wall which, in operation, is acted on by heat on a first wall side and is acted on by a flow of cooling fluid on a second wall side;

the wall having at least one plug and at least one emergency cooling opening which is closed off by the at least one plug, cooling fluid flowing through the at least one emergency cooling opening from the second wall side to the first wall side when the at least one plug is absent;

the plug being configured and arranged to melt at a predetermined temperature;

the at least one plug comprising a body which is produced separately from the component; and the at least one plug being inserted into the emergency cooling opening, in which the at least one plug is connected to the component;

wherein each at least one plug has a plug body having the predetermined melting point; and wherein the plug body has a protective layer which:

acts as a diffusion barrier between the material of the plug body and the material of the wall, protects the plug body from oxidation, corrosion, erosion, or combinations thereof, or both.

2. The emergency cooling system as claimed in claim 1, wherein the at least one plug is soldered or welded into an associated at least one emergency cooling opening.

3. The emergency cooling system as claimed in claim 1, wherein the plug is connected to the component in a positively locking manner in an associated at least one emergency cooling opening.

4. The emergency cooling system as claimed in claim 3, wherein the at least one plug has a first positive locking contour;

the at least one emergency cooling opening has a second positive locking contour which is complementary to the first positive locking contour; and the first positive locking contour and second positive locking contour are configured and arranged so that the at least one plug can be inserted into the at least one emergency cooling opening on the first wall side.

5. The emergency cooling system as claimed in claim 3, wherein the at least one plug has an external screw thread and is screwed into the associated at least one emergency cooling opening, the at least one emergency cooling opening including an internal screw thread which is complementary to the external screw thread.

6. The emergency cooling system as claimed in claim 1, wherein the at least one plug is configured and arranged to melt when it is exposed to the predetermined temperature or a higher temperature, for a predetermined time.

7. The emergency cooling system as claimed in claim 1, wherein the melting point of the at least one plug is selected to be greater than the maximum temperature permissible for normal operation of the component and lower than the melting point of the component.

8. The emergency cooling system as claimed in claim 1, wherein the at least one plug is configured and arranged to melt relatively quickly when the melting point of the at least one plug is reached.

9. The emergency cooling system as claimed in claim 1, wherein the protective layer comprises a thin Pt layer.

10. The emergency cooling system as claimed in claim 1, wherein the component comprises a component of a turbine.

11. The emergency cooling system as claimed in claim 1, wherein the protective layer comprises a Pt layer and an Al layer.

12. The emergency cooling system as claimed in claim 1, wherein the protective layer comprises an Al layer or an Al alloy layer.

13. An emergency cooling system for a component which is subject to thermal load in operation, comprising:

a component having a wall which, in operation, is acted on by heat on a first wall side and is acted on by a flow of cooling fluid on a second wall side;

the wall having at least one plug and at least one emergency cooling opening which is closed off by the at least one plug, cooling fluid flowing through the at least one emergency cooling opening from the second wall side to the first wall side when the at least one plug is absent;

the plug being configured and arranged to melt at a predetermined temperature;

the at least one plug comprising a body which is produced separately from the component; and the at least one plug being inserted into the emergency cooling opening, in which the at least one plug is connected to the component;

wherein the at least one plug or the plug body comprises an Ni-based alloy which contains an alloying constituent selected from the group consisting of Hf, Si, Zr, Cr, Al, Ti, Nb, B, Co, and combinations thereof;

wherein, to set a predetermined melting point (Tm) for the at least one plug or for the plug body, the percentages by weight of the individual alloying constituents are selected so that the following equation applies:

$$Tm=(1460-9.5\times Hf-30\times Si-170\times Zr-2.75\times Cr-9.4\times Al-10.6\times Ti-10.8\times Nb-208\times B+1\times Co)^\circ\ C.;\ \text{and}$$

wherein the individual alloying constituents being introduced into the equation on the basis of their percentages by weight.

14. The emergency cooling system as claimed in claim 13, wherein the at least one plug is soldered or welded into an associated at least one emergency cooling opening.

15. The emergency cooling system as claimed in claim 13, wherein the plug is connected to the component in a positively locking manner in an associated at least one emergency cooling opening.

16. The emergency cooling system as claimed in claim 13, wherein the at least one plug is configured and arranged to melt when it is exposed to the predetermined temperature or a higher temperature, for a predetermined time.

17. The emergency cooling system as claimed in claim 13, wherein the melting point of the at least one plug is selected to be greater than the maximum temperature permissible for normal operation of the component and lower than the melting point of the component.

18. The emergency cooling system as claimed in claim 13, wherein the at least one plug is configured and arranged to melt relatively quickly when the melting point of the at least one plug is reached.

19. The emergency cooling system as claimed in claim 13, wherein the component comprises a component of a turbine.

20. An emergency cooling system for a component which is subject to thermal load in operation, comprising:

a component having a wall which, in operation, is acted on by heat on a first wall side and is acted on by a flow of cooling fluid on a second wall side;

the wall having at least one plug and at least one emergency cooling opening which is closed off by the at least one plug, cooling fluid flowing through the at least one emergency cooling opening from the second wall side to the first wall side when the at least one plug is absent;

the plug being configured and arranged to melt at a predetermined temperature;

the at least one plug comprising a body which is produced separately from the component; and the at least one plug being inserted into the emergency cooling opening, in which the at least one plug is connected to the component;

wherein the at least one plug or plug body comprises one of the following Ni-based alloys:

Ni—Hf alloy containing from 25 to 30% by weight of Hf, remainder Ni;

Ni—Si alloy containing from 7 to 12% by weight of Si, remainder Ni;

Ni—Hf—Si alloy containing from 20 to 30% by weight of Hf, from 5 to 120% by weight of Si, remainder Ni;

Ni—Hf—Si—Cr—Al alloy containing from 10 to 30% by weight of Hf, from 5 to 12% by weight of Si, from 5 to 30% by weight of Cr, from 2 to 5% by weight of Al, remainder Ni;

Ni—Hf—Cr—Al—Si—Co—Ti—Ta—Nb—Zr alloy containing from 5 to 20% by weight of Hf, from 5 to 30% by weight of Cr, from 2 to 5% by weight of Al, from 4 to 12% by weight of Si, from 0 to 25% by weight of Co, from 0 to 5% by weight of Ti, from 0 to 5% by weight of Ta, from 0 to 5% by weight of Nb, from 0.3 to 3% by weight of Zr, remainder Ni;

Ni—Hf—Cr—Al—Si—Co—Ti—Ta—Nb—Zr—B alloy containing from 5 to 20% by weight of Hf, from 5 to 30% by weight of Cr, from 2 to 5% by weight of Al, from 4 to 12% by weight of Si, from 0 to 25% by weight of Co, from 0 to 5% by weight of Ti, from 0 to 5% by weight of Ta, from 0 to 5% by weight of Nb, from 0.3 to 3% by weight of Zr, from 0 to 2.5% by weight of B, remainder Ni.

21. The emergency cooling system as claimed in claim 20, wherein the at least one plug is soldered or welded into an associated at least one emergency cooling opening.

22. The emergency cooling system as claimed in claim 20, wherein the plug is connected to the component in a positively locking manner in an associated at least one emergency cooling opening.

23. The emergency cooling system as claimed in claim 20, wherein the at least one plug is configured and arranged to melt when it is exposed to the predetermined temperature or a higher temperature, for a predetermined time.

24. The emergency cooling system as claimed in claim 20, wherein the melting point of the at least one plug is selected to be greater than the maximum temperature permissible for normal operation of the component and lower than the melting point of the component.

25. The emergency cooling system as claimed in claim 20, wherein the at least one plug is configured and arranged to melt relatively quickly when the melting point of the at least one plug is reached.

26. The emergency cooling system as claimed in claim 20, wherein the component comprises a component of a turbine.

27. An emergency cooling system for a component which is subject to thermal load in operation, comprising:

a component having a wall which, in operation, is acted on by heat on a first wall side and is acted on by a flow of cooling fluid on a second wall side;

the wall having at least one plug and at least one emergency cooling opening which is closed off by the at least one plug, cooling fluid flowing through the at least one emergency cooling opening from the second wall side to the first wall side when the at least one plug is absent;

the plug being configured and arranged to melt at a predetermined temperature;

the at least one plug comprising a body which is produced separately from the component; and the at least one plug being inserted into the emergency cooling opening, in which the at least one plug is connected to the component;

wherein the plug is connected to the component in a positively locking manner in an associated at least one emergency cooling opening;

wherein the at least one plug has first bayonet catch elements and is anchored in an associated at least one emergency cooling opening; and wherein the at least one emergency cooling opening has second bayonet catch elements which are complementary to the first bayonet catch elements.

28. The emergency cooling system as claimed in claim 27, wherein the at least one plug is soldered or welded into an associated at least one emergency cooling opening.

29. The emergency cooling system as claimed in claim 27, wherein the at least one plug is configured and arranged to melt when it is exposed to the predetermined temperature or a higher temperature, for a predetermined time.

30. The emergency cooling system as claimed in claim 27, wherein the melting point of the at least one plug is selected to be greater than the maximum temperature permissible for normal operation of the component and lower than the melting point of the component.

31. The emergency cooling system as claimed in claim 27, wherein the at least one plug is configured and arranged to melt relatively quickly when the melting point of the at least one plug is reached.

32. The emergency cooling system as claimed in claim 27, wherein the component comprises a component of a turbine.

* * * * *